US009247818B2

(12) United States Patent
Shively

(10) Patent No.: US 9,247,818 B2
(45) Date of Patent: Feb. 2, 2016

(54) PORTABLE FOLDING CHAIR WITH REMOVABLE STORAGE MODULE

(71) Applicant: Matthew Shively, Auburn, IN (US)

(72) Inventor: Matthew Shively, Auburn, IN (US)

( * ) Notice: Subject to any disclaimer, the term of this patent is extended or adjusted under 35 U.S.C. 154(b) by 0 days.

(21) Appl. No.: 14/200,372

(22) Filed: Mar. 7, 2014

(65) Prior Publication Data

US 2014/0319883 A1 Oct. 30, 2014

Related U.S. Application Data

(60) Provisional application No. 61/774,670, filed on Mar. 8, 2013.

(51) Int. Cl.

| | |
|---|---|
| ***A47C 4/28*** | (2006.01) |
| ***A47C 7/62*** | (2006.01) |
| ***A47C 7/54*** | (2006.01) |
| ***A47C 7/24*** | (2006.01) |
| ***A47C 7/38*** | (2006.01) |
| ***A47C 7/72*** | (2006.01) |

(52) U.S. Cl.

CPC ... *A47C 4/28* (2013.01); *A47C 7/24* (2013.01); *A47C 7/38* (2013.01); *A47C 7/62* (2013.01); *A47C 7/72* (2013.01)

(58) Field of Classification Search

CPC ..... B60N 2/4686; B60N 3/102; A47C 4/28; A47C 7/54; A47C 7/62; A47C 7/68; A47C 7/72

USPC ..... 297/188.18, 188.19, 188.14, 45, 35, 297/16.2, 188.16, 188.15, 188.17

See application file for complete search history.

(56) References Cited

U.S. PATENT DOCUMENTS

| | | | | |
|---|---|---|---|---|
| 3,233,940 | A * | 2/1966 | Tooley, Jr. | 297/188.18 |
| 4,106,829 | A * | 8/1978 | Dolle et al. | 312/235.8 |
| 4,428,617 | A | 1/1984 | Lawson | |
| 4,474,407 | A | 10/1984 | Nazar | |
| 5,720,516 | A * | 2/1998 | Young | 297/188.18 |
| 6,000,752 | A | 12/1999 | Shyr | |
| 6,149,238 | A * | 11/2000 | Tsai | 297/411.43 |
| 6,840,574 | B1 * | 1/2005 | Wu | 297/45 |
| 6,942,289 | B2 * | 9/2005 | McBride | 297/188.14 |
| 7,309,106 | B2 | 12/2007 | Stallman | |
| 2002/0148868 | A1 * | 10/2002 | Dion-Bildstein et al. | 224/401 |
| 2010/0096890 | A1 * | 4/2010 | Whitlock | 297/16.2 |
| 2013/0292971 | A1 * | 11/2013 | Larson et al. | 297/173 |

FOREIGN PATENT DOCUMENTS

| | | |
|---|---|---|
| WO | WO9701299 | 1/1997 |
| WO | WO2006039578 | 4/2006 |

OTHER PUBLICATIONS

Folding Chair with Built-In Collers: Gadgetking.com, Feb. 22, 2010, retrieved from http://www.gadgetking.com/2010/02/22/folding-chair-with-built-in-coolers/.

PolarHeat Heated and Colled Oversized Folding Chair and Cooler: PolarHeat, Aug. 31, 2011, http://www.amazon.com/PoiarHeat-Heated-Cooled-Oversized-Folding/dp/B001G8X188.

(Continued)

*Primary Examiner* — Milton Nelson, Jr.

(57) ABSTRACT

A foldable, portable chair with at least one removable, user-configurable storage module, preferably a soft-sided cooler, adapted to fit in and hang from one or more chair arms when the chair is deployed for sitting.

5 Claims, 4 Drawing Sheets

(56) References Cited

OTHER PUBLICATIONS

Coleman Oversized Quad Chair with Cooler, Coleman, Aug. 31, 2011, http://www.amazon.com/Coleman-Broadband-Quad-Chair-Cooler/dp/B00339910A/ref=sr__1__sc__2?s=sporting-goods&ie=.

Deluxe Folding Chair, Aug. 31, 2011, retrieved from http://www.alibaba.com/product-gs/460576918/Delux__folding__chair.html.

Folding Chair with Cooler Bag, Aug. 31, 2011, retrieved from http//www.alibaba.com/product-gs/359966731/Foidlng__chair__with__cooler__bag.html.

Folding Beach Chair Doubie Seat Arm Chair with Cooler Bag. Aug. 31, 2011: ret. from http://www.alibaba.com/product-gs/320248191/folding__beach__chair__double__seat__arm.html.

* cited by examiner

PORTABLE FOLDING CHAIR WITH REMOVABLE STORAGE MODULE

CROSS-REFERENCES TO RELATED APPLICATIONS

This Application claims priority to, and incorporates in its entirety, U.S. Provisional Application Ser. No. 61/774,670, filed on Mar. 8, 2013.

STATEMENT REGARDING FEDERALLY SPONSORED RESEARCH OR DEVELOPMENT

Not applicable

Chair Background

Portable folding chairs are commonly used for recreational purposes in settings where portable temporary chair seating is desired, such as at campgrounds, outdoor social gatherings, automobile races, and other sporting events. In the contexts in which portable chairs are commonly used, it is also often desirable to transport a cooler for beverage or food, or other devices for food or beverage storage.

Portable folding chairs are typically constructed of a jointed folding frame supporting cloth or canvas surfaces for the chair seat, chair back, and chair arms. It is known to the art for such chairs to be constructed to fold for storage and transportation in a bag or container. Portable folding chairs known to the art have the disadvantage of providing little or no internal storage capacity, requiring users to carry a cooler or other food or beverage storage device separately from the chair.

Attempts have been made in the art to overcome this shortcoming by integrating a cooler into the chair seat or a chair arm. Chairs known to the art with integrated coolers sacrifice much of their utility as portable chair seating because they are larger than typical portable folding chairs, and thus difficult to fold and awkward to transport. Many integrated cooler designs known to the art are further undesirably large after folding.

In an attempt to reduce the bulk and size of chairs with integrated coolers, folding chairs known to the art are sometimes designed with integrated cooler or storage space that is insufficient to replace a separately carried cooler or storage device. Undue overall size and insufficient storage space are undesirable side effects which erase much of the point of integrating a cooler or storage chamber with the chair in the first place.

Folding chair designs known to the art with storage in the chair arms have additional shortcomings. Such designs typically employ a chair armrest structure dedicated to the storage function such that the armrest cannot easily be used to rest the user's arm, thus sacrificing the primary function of the chair armrest in favor of a storage function. Also, folding chair designs known to the art including storage in the chair armrest do not provide the user with an ability to customize or modify the function or size of the storage space.

Embodiments of the present invention address the need for a portable folding chair assembly with user-configurable storage spaces, that easily folds and transports without requiring the user to carry a separate cooler or storage device. Embodiments of the present invention further address the need for a portable folding chair capable of accommodating sufficient storage space to replace a separately carried travel cooler or storage device. Embodiments of the present invention further address the need for a portable folding chair assembly with cooler or storage space in the chair armrests that permits the user to continue to use the chair arm as a convenient place to rest his or her chair arm.

BRIEF SUMMARY

Embodiments of the present invention are directed to a portable folding chair assembly with user-configurable storage modules detachably attached to each chair armrest. In one embodiment, the chair assembly comprises a support frame supporting a flexible chair seat, chair back, and chair arms, which can fold into a compact unit that can be stored and transported in a bag or other container. In other embodiments, the chair seat, chair back, and chair arms are composed of flexible, foldable material such as canvas or cloth that are joined to the folding frame by connectors such as rivets, eyelets, or other connectors known to the art. Embodiments further comprise support spacers providing structural support for the rear-most portion of each chair armrest such that the chair armrest does not sag unduly under the weight of stored items, a user's arm, or the combined weight of stored items and a user's arm.

One or more chair arms further comprise one or more interface openings, wherein each interface opening is supported substantially around its perimeter. An interface opening is adapted to accept a user-configurable storage module. The interface opening may further comprise a support frame, which support frame may be connected to the folding frame of the chair assembly. In one embodiment this connection comprises the flexible material of the chair arm. Optionally, the support frame of the interface opening is connected to the chair folding frame by other support members, which may themselves be foldable. In a preferred embodiment, the support frame of the interface opening comprises a portion of the folding frame of the chair.

Storage modules are adapted in embodiments herein to be user-configurable, detachable, and interchangeable. Storage modules are comprised in part of hangars, which extend around all or part of the perimeter of the storage module such that said hangars integrate with the support frame of the interface opening. Said storage modules connect to the chair arm through the interface opening by means of a detachable connection between the hangars and the support frame of the interface opening.

Optionally, embodiments of the present invention include fully or partially detachable covers adapted to cover one or more of an interface opening or a storage module. Optionally, such covers are capable of bearing weight when installed, and are preferably capable of bearing the weight of a user's arm resting on the chair armrest.

Other embodiments and advantages of the invention will be apparent to those skilled in the art.

BRIEF DESCRIPTION OF THE DRAWINGS

These and other features, aspects, and advantages of the present invention will become better understood with regard to the following description and accompanying drawings, where.

DETAILED DESCRIPTION

Figure 1:
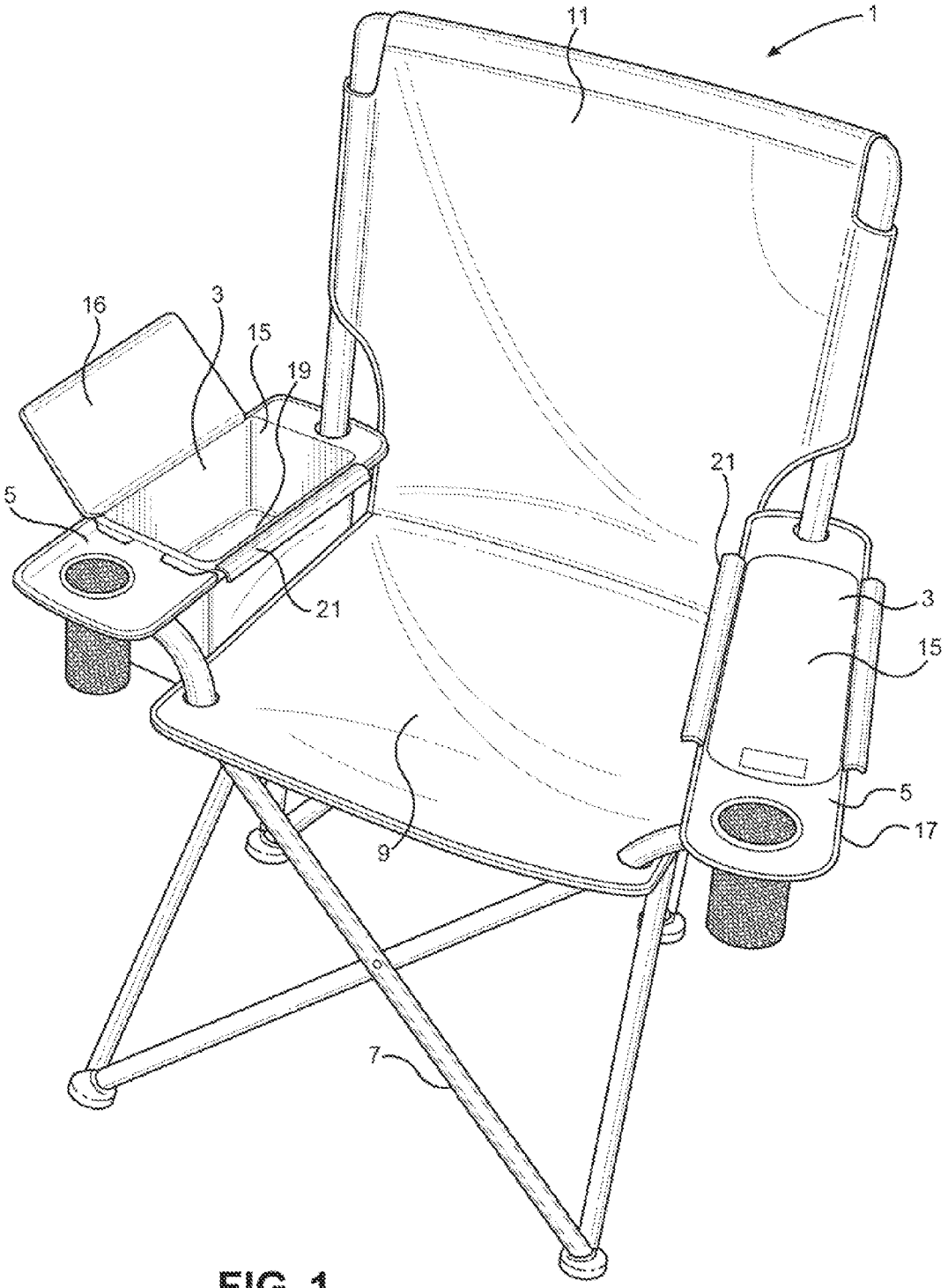
FIG. 1 shows a perspective view of a chair assembly of one embodiment of the present invention deployed for sitting with a cooler storage module installed in one chair armrest and an optional weight-bearing cover installed over an interface opening within the other chair armrest.
Figure 2:
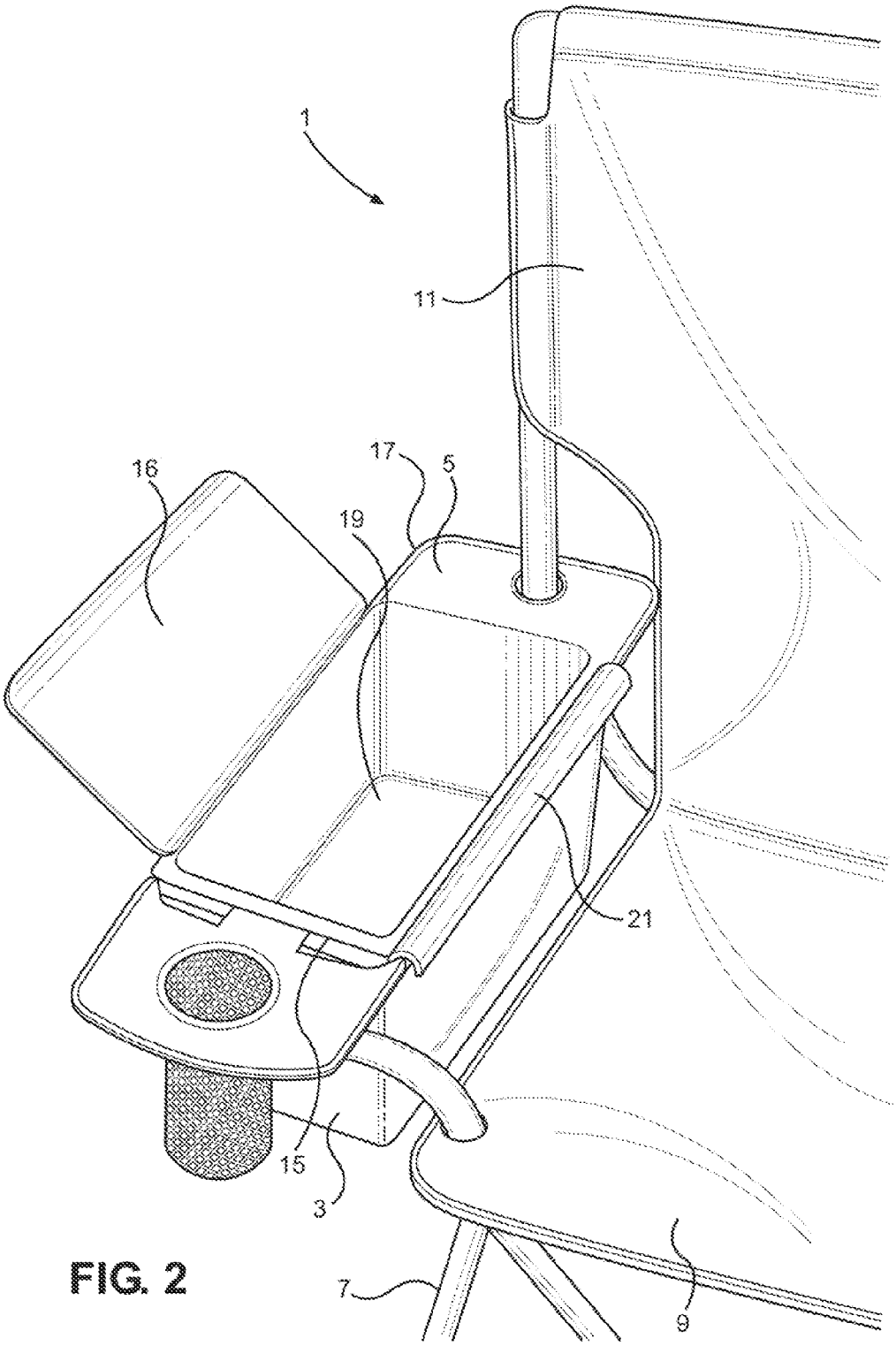
FIG. 2 shows an enlarged view of a one chair arm in one embodiment of the present invention, with a cooler storage module installed.
Figure 3:
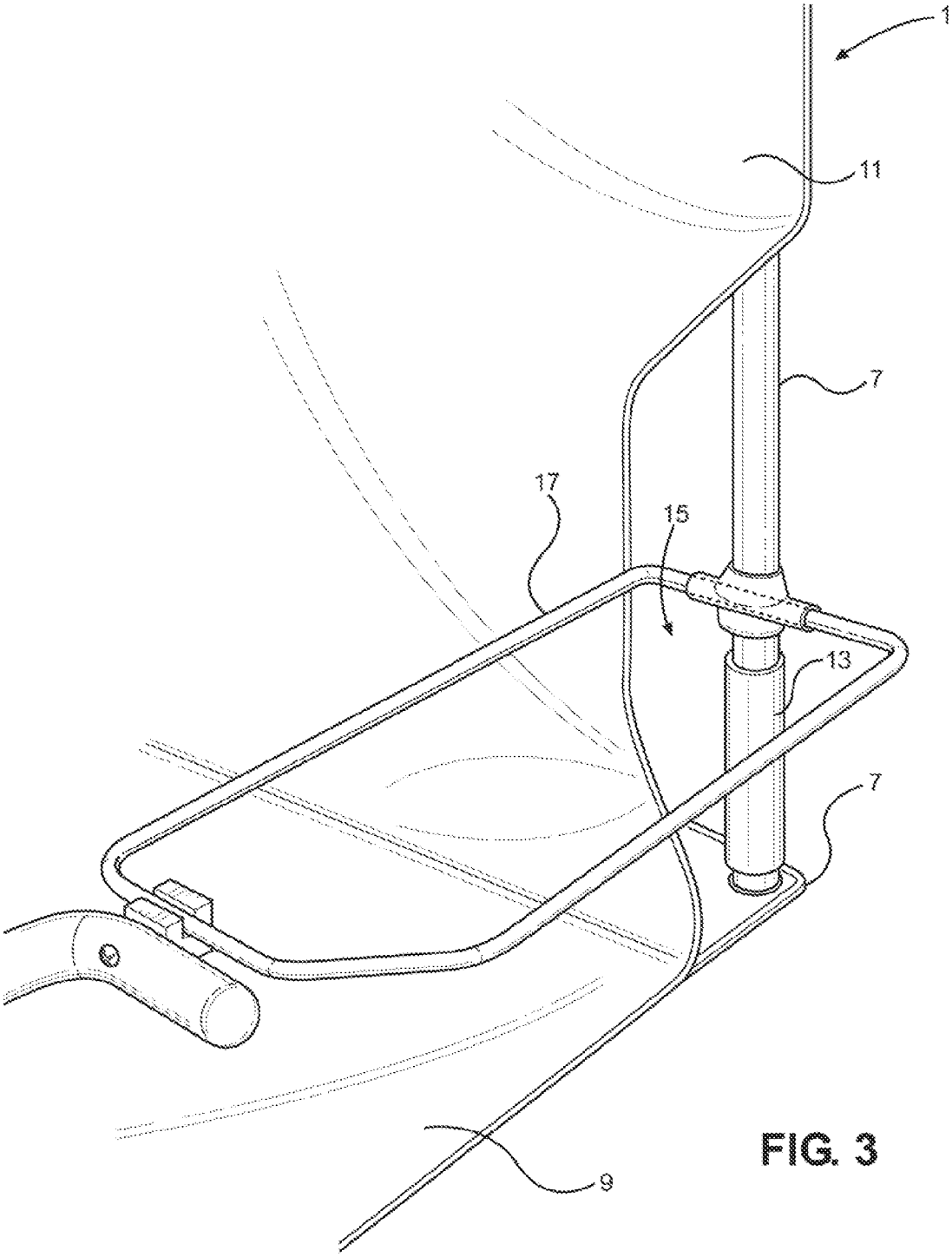
FIG. 3 shows an enlarged perspective view of a chair arm support in some embodiments of the present invention.
Figure 4:
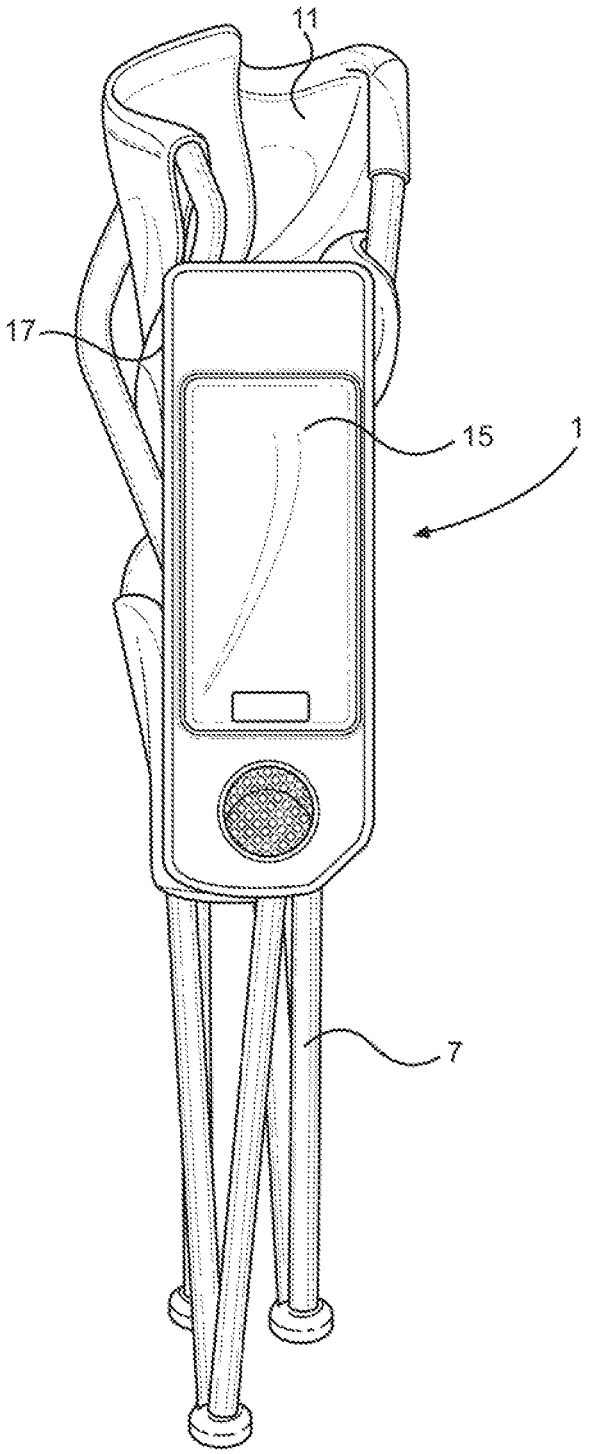
FIG. 4 shows a perspective view of a chair assembly with storage modules installed folded in preparation for storage and transportation in one embodiment of the present invention.

Embodiments of the present invention are directed towards a portable, foldable chair assembly [1] including a system of interchangeable, detachable storage modules [3] for storage of food and beverages. As shown in FIG. 1, a chair assembly [1] comprises a jointed, folding frame [7] supporting a chair seat [9], chair back [11], and chair arms [5].

The folding frame [7] can fold such that the chair assembly [1] can be stored in a bag or compartment for transportation. The folding frame [7] may further unfold to deploy the chair assembly [1] in a sitting configuration. As will be appreciated by one skilled in the art, the folding frame [7] when deployed for sitting comprises feet or legs, a support structure for a seat, a support structure for arms, and a support structure for a chair back, preferably comprising framing for the perimeter of the seat, arms, and back. Preferably, the folding frame [7] provides sufficient structural support to the chair seat [9], chair back [11], and chair arms [5] for the chair assembly [1] to accommodate the weight of a user, preferably an adult, within typical weight ranges. It will be appreciated by those skilled in the art that the folding frame [7] may be strengthened within the scope of this invention to support heavier weights, such as larger individuals, weakened for uses where lighter weights are anticipated, such as children, increased in size for a larger chair assembly [1], or reduced in size for a smaller chair assembly [1].

The folding frame [7] optionally comprises support spacers [13] which provide structural support to the rear-most terminal end of each chair arm [5]. Said support spacers [13] preferably provide sufficient support to the rear-most terminal end of each chair arm [5] prevent each chair arm [5] from sagging substantially when storage modules [3] are installed containing materials such as ice and beverages.

The chair seat [9], chair back [11], and chair arms [5] are made of any suitable material sufficiently flexible to fold with the folding of the folding frame [7], and having sufficient tensile strength to hold the weight of a user when the chair assembly [1] is deployed for sitting. In preferred embodiments, the user is an adult. Preferably, the chair seat [9], chair back [l], and chair arms [5] are made of canvas and are attached to the folding frame [7] substantially around the perimeter of each of the chair seat [9], chair back [11], and chair arms [5]. It will be appreciated by those skilled in the art that such materials may be altered, reinforced, or provided in greater thickness within the scope of this invention to support heavier weights, such as larger individuals, or reduced or provided in lesser thickness to support lighter weights, such as children.

At least one chair arms [5] comprises an interface opening [15] adapted to accept a storage module [3]. In one embodiment, the interface opening [15] is substantially the same shape as a chair arm [5] and of a slightly smaller size than the exterior dimensions of said chair arm [5]. In another embodiment, an interface opening [15] is substantially the same shape as a chair arm [5] and of a substantially smaller size than the exterior dimensions of said chair arm [5]. In still other embodiments, an interface opening [15] is a different shape than the shape of a chair arm [5]. An interface opening [15] can be any shape or size, provided the interface opening [15] is contained within the exterior dimensions of at least one chair arm [5]. In other embodiments, the interface opening [15] comprises the chair arm [5] and is defined by the portion of the folding frame [7] defining the chair arm [5]. It will be appreciated by those skilled in the art that chair assemblies [1] within the scope of this invention may comprise one chair arm [5] comprising an interface opening [15], may comprise two chair arms [5] comprising identical interface openings [15], or may comprise multiple chair arms [5] each comprising an interface opening [15] adapted to accommodate differing storage modules [3].

Optionally, a wholly or partially detachable interface opening cover [16] is adapted to cover the interface opening [15]. The interface opening cover [16] can be made of any material suitable for the chair arms [5]. The interface opening cover [16] may be detachably connected around its perimeter in a manner suitable to cover the interface opening [15] to one or more of the interface opening [15], storage module support frame [17], or chair arm [5] by fasteners such as zippers, buttons, hook-and loop connectors, or other suitable mechanical connections.

Optionally, the interface opening cover [16] is fixedly connected to one or more of the chair arm [5], storage module support frame [17], and interface opening [15] at one end, and detachably connected to one or more of the chair arm [5], storage module support frame [17], and interface opening [15] at the other end by fasteners such as zippers, buttons, hook-and-loop connectors, or other suitable mechanical connections. Optionally, an interface cover [16] can be integrated into a storage module [3]. The interface opening cover [16] is, when deployed to cover an interface opening [15], of suitable strength to support the weight of the arm of a user of the chair assembly [1].

An interface opening [15] according to versions of the present invention comprises in part a storage module support frame [17]. A storage module support frame [17] comprises a support structure extending substantially around the perimeter of the interface opening [15]. The storage module support frame [17] can be made of any suitable material that is sufficiently rigid to support the weight of an installed storage module [3] filled with materials such as ice and beverages. In some embodiments, the storage module support frame [17] is connected to the chair folding frame [7] through the material of the chair arm [5]. In other versions of the present invention, the storage module support frame [17] is connected directly at one or more points to the chair folding frame [7]. In other versions of the invention, the storage module support frame [17] is comprised of one or more portions of the chair folding frame [7] forming the perimeter of the chair arm [5].

Storage modules [3] according to versions of the present invention are interchangeable, removable modules for the storage of ice, beverages, food, or other items. Storage modules [3] comprise a storage compartment [19], a storage module hangar [21], and, optionally, an interface opening cover [16]. Storage modules [3] can be made of any material sufficiently flexible to be folded and sufficiently durable to serve the storage function intended by the storage module [3]. Storage modules [3] can be of any shape or size sufficient to fit the interface opening [15] for which they are intended. By way of illustration, storage modules [3] can comprise soft-sided beverage coolers, net storage sacks, or hard-sided storage containers. It will be appreciated by those skilled in the art that many other sizes, shapes, and functions are available for storage modules [3] within the scope of the invention herein.

The storage module hangar [21] comprises a support structure extending around at least part of the perimeter of a storage module [3]. The storage module hangar [21] of versions of the present invention is adapted to detachably connect to a storage module support frame [17] such that the storage module [3] hangs within the interface opening [15] when the chair assembly [1] is deployed for sitting, preferably held in place by gravity. Optionally, the storage module hangar [21] is detachably connected to the storage module support frame [17] by one or more of straps, buttons, zippers, hooks, friction-fit connectors, hook-and-loop connectors, or other suitable mechanical fasteners.

The storage module hangar [21] can be made of any suitable material that is sufficiently rigid to support the weight intended to be carried by the storage module [3] to which it is attached. It will be apparent to one skilled in the art that a larger storage module [3] configured to carry relatively heavy items, such as a beverage cooler intended to carry ice and beverages, may require a storage module hangar [21] that is structurally stronger, or extends around a greater portion of the perimeter of the storage module [3], than is needed by a storage module [3] configured to carry lighter items.

Storage modules [3] may be made of any material sufficiently flexible to remain interfaced with the chair assembly [1] when the chair assembly [1] is folded for transportation and storage. Preferably, the chair assembly (1 and one or more storage modules [3] are folded and stored or transported together. Further preferably, a storage module [3] comprises in part materials adapted to maintain the temperature of items placed into the storage compartment [19]. Optionally, storage modules [3] may be removed from the chair assembly [1] before the chair assembly [1] is folded for transportation or storage, and said storage modules [3] may be stored or transported separately from the chair assembly [1]. Optionally, storage modules [3] may have handles, straps, or other mechanical aids to enable transportation or storage separate from the chair assembly [1].

In a preferred embodiment herein, a portable, foldable chair assembly [1] comprises a folding frame [7] that includes four legs, a chair seat portion defining the perimeter of a chair seat, chair arm portions defining the perimeter of chair arms, and a chair back portion defining the perimeter of a chair back; a chair back [9] attached to the chair back portion of said folding frame [7]; a chair seat [11] attached to the chair seat portion of said folding frame [7]; and chair arms [5] attached to said chair arm portion of said folding frame, at least one of said chair arms [5] further comprising an interface opening [15], said interface opening comprising an storage module support frame [17]; wherein a storage module [3] comprises a storage compartment [19] and a storage module hangar [21], and said storage module hangar [21] is detachably attached to said storage module support frame [17] such that said storage module [3] hangs in place from said chair arm [5] when said chair assembly [1] is deployed for sitting and folds up with said chair assembly [1] when said chair assembly [1] is folded for storage or transport.

What is claimed is:

1. A portable, foldable chair assembly comprising:

(a) a folding frame, said folding frame comprising four legs, a chair seat portion defining the perimeter of a chair seat connected to said legs, two chair arm portions defining the perimeters of two chair arms connected to one or more of said seat portion and said legs, and a chair back portion defining the perimeter of a chair back connected to one or more of said legs, said chair seat portion, and said chair arm portion;

(b) a back support attached to the chair back portion of said folding frame;

(c) a seat support attached to the chair seat portion of said folding frame;

(d) two arm supports, wherein each arm support is attached to one of said two chair arm portions of said folding frame, and wherein at least one of said chair arm supports further comprises an interface opening and said interface opening comprises a storage module support frame;

(e) a storage module comprising a storage compartment, said storage compartment comprising a soft-sided cooler adapted to store food and beverages, and a storage module hangar, wherein said storage module hangar is detachably attached to said storage module support frame such that said storage module hangs from at least one of said interface openings when said portable, foldable chair assembly is deployed for sitting.

2. The portable, foldable chair assembly of claim 1, wherein at least one of said arm supports further comprises an interface opening cover.

3. The portable, foldable chair assembly of claim 2, wherein said interface opening cover is detachably attached to one or more of said arm support or said storage module support frame.

4. A portable, foldable chair assembly comprising:

(a) a folding frame, said folding frame comprising four legs, a chair seat portion defining the perimeter of a chair seat connected to said legs, two chair arm portions defining the perimeters of two chair arms connected to one or more of said seat portion and said legs, and a chair back portion defining the perimeter of a chair back connected to one or more of said legs, said chair seat portion, and said chair arm portion;

(b) a back support attached to the chair back portion of said folding frame;

(c) a seat support attached to the chair seat portion of said folding frame;

(d) two arm supports, wherein each arm support is attached to one of said two chair arm portions of said folding frame, and wherein each of said chair arm supports further comprises an interface opening, and each of said interface openings comprises a storage module support frame;

(e) at least one storage module comprising a storage compartment, said storage compartment comprising a soft-sided cooler adapted to store food and beverages and a storage module hangar, wherein said storage module hangar is detachably attached to at least one said storage module support frame such that said at least one storage module hangs from at least one of said interface openings when said portable, foldable chair assembly is deployed for sitting.

5. The portable, foldable chair assembly of claim 4, wherein at least one of said arm supports further comprises an interface opening cover.

* * * * *